United States Patent [19]

Bourland

[11] Patent Number: 4,630,369

[45] Date of Patent: Dec. 23, 1986

[54] TWO BLADED WALLPAPER TRIMMER

[76] Inventor: Tommy E. Bourland, 308 Barcelona St., Vallejo, Calif. 94591

[21] Appl. No.: 766,682

[22] Filed: Aug. 19, 1985

Related U.S. Application Data

[63] Continuation-in-part of Ser. No. 583,824, Feb. 27, 1984, abandoned.

[51] Int. Cl.[4] ..... B26B 29/00

[52] U.S. Cl. ..... 30/294; 30/2; 30/304

[58] Field of Search ..... 30/2, 115, 287, 289, 30/290, 294, 299, 303, 304

[56] References Cited

U.S. PATENT DOCUMENTS 4,408,396 10/1983 Scholl ..... 30/294

FOREIGN PATENT DOCUMENTS 629521 9/1949 United Kingdom ..... 30/299

*Primary Examiner*—Douglas D. Watts

*Attorney, Agent, or Firm*—Harry A. Pacini

[57] ABSTRACT

A handtool for close edge trimming of sheet material, of the pull-type for manual use and toward the user in a forward direction during the cutting action of the tool; including an acute angularly shaped flat base plate having therein near the forward point on opposite sides protruding there from parallel cutting edges; the cutting edges extend outwardly through slots in the bevel shaped angular guiding edges of the base plate, said slots formed by parallel recesses in the base plate and a removable closure plate covering the recesses; and an upwardly projecting handle fixedly secured the base plate and conveniently shaped to be grasped by the user's hand.

8 Claims, 3 Drawing Figures

TWO BLADED WALLPAPER TRIMMER

This is a continuation-in-part of application Ser. No. 583,824 filed Feb. 27, 1984 now abandoned.

BACKGROUND OF THE INVENTION

This invention relates to a handtool of the pull type intended to be used by manually grasping the tool, and pulling towards the user's body during the cutting action of the tool. More particularly, the invention relates to a handtool suitable for close edge trimming of sheet material, such as, for example wallpaper, vinyl, adhesive backed sheet material for covering shelves, lining drawers and the like, wherein the sheet material must be held against the surface while trimming to obtain creased or cleanly produced edging at edges and corners.

The subject invention is a novel and valuable cutting tool particularly adapted for use as an edgetrimmer of wallpaper, while the wallpaper has been hung on a wall, and at the ideal time for trimming. Thus it is necessary, if a good fit is to be achieved, that the cut edge be particularly close to the edge at the meeting line formed by wall surfaces, ceiling, floor or baseboard at an angle (usually a 90° angle with respect to any two surfaces).

Whereas various cutting tools have been disclosed for this purpose, none have been suitable for close edge trimming of wallpaper while creasing the wallpaper in the angle fromed by the surfaces holding the wallpaper securely while cutting at the meeting line of the surfaces. The adjacent edges at the meeting line of the surfaces should be complementary.

Various cutting tools have been disclosed for the purpose. At least one type includes a vertically disposed cutting blade secured to a handle which may be grasped manually by the user. Even when such a cutting blade arrangement is associated with a base plate the cut edge produced thereby is not sufficiently close to the meeting line of the surfaces as described herein above. Therefore, there is no possibility of holding the sheet material firmly against the surface to be covered while cutting the desired close edge to the meeting line of the surfaces.

In another instance a hand tool cutter incorporates in its edge-trimmer a cutting edge, however, the head of said tool in which the cutting edge protrudes is oppositely bevelled to a special angle. The head therefore has a pair of guiding surfaces equally angularly spaced away from the opposite sides of the flat of the cutting blade, the angle approaching 90°.

Various objects, advantages, and features of this invention will be expressly pointed out or become apparent in the following detailed description of illustrative embodiments of the invention as shown in the accompanying drawings.

SUMMARY OF THE INVENTION

It is a general object of the invention to provide a hand tool for cutting sheet material, such as wallpaper and the like, intended to obviate and minimize problems associated with close-edge trimming of such material.

It is a particular object of the invention to provide a hand tool for cutting sheet material so designed as to particularly facilitate the production of a cut edge of the sheet material in close proximity to the edge of the object to which the sheet material is applied.

It is a further object of the invention to provide a hand tool for accurately cutting sheet material designed to hold said sheet material securely against the object to which the sheet material is applied to effect a close cut edge coincident with the edge of the object or edge of the surface being covered.

A further object of the invention is to provide a hand tool for cutting flat sheet material wherein the cutting action of the tool is such as to minimize unsteadiness of the users hand during cutting.

A further object of the invention is to provide a hand tool of the pull-type for cutting flat sheet material with right and left cutting edges for alternatively trimming while holding the sheet material securely against the object to which the sheet material is being applied.

One preferred embodiment of the invention intended to accomplish the foregoing objects, but not specifically limited thereto and intended to emcompass equivalents as understood by those skilled in this art is a hand tool for cutting sheet material such as wallpaper, lining material for drawers and shelves, and the like. The tool is of the pull-type intended to be grasped manually by a user and pulled toward the user in a backward direction during the cutting action.

The tool included a base plate having a flat, lower, horizontal surface shaped and adapted to abutt slidingly with the flat sheet material. Said base plate having a forward angularly shape with beveled angular guiding edges. An upwardly projecting handle fixedly secured to the base plate and shaped to be grasped by the user's hand in a clenched position. With the palm disposed in a generally horizontal plane, thumb foremost. A pair of cutting edges are provided in the base plate one on each side thereof, each extending a cutting corner positioned beyond the beveled guiding edge of the base plate. Extending outwardly and angularly with respect to the angular shaped arrow-head-like base plate and the cutting edges, the cutting edges are securely but removably seated in redesses in the base plate and communicating with said recesses resulting in exteriorly disposed cutting corners. means are provided for securely but removably connecting the cutting blades within the recesses in the base plate.

In a preferred embodiment, the means for securing the blades to the base plate included a pair of substantially horizontal parallel recesses or channels in the base plate to accept the blade and a removable closure plate covering the blade recesses. Means are provided for removably securely afixing the closure plate to the base to retain the blades in the recesses in cutting orientation.

DESCRIPTION OF THE DRAWINGS

Various other objects, advantages and features of the invention will be expressly pointed out or become apparent in the course of the following detailed description of the illustrative embodiment of the invention as illustrated in the accompanying drawings, in which.

DETAILED DESCRIPTION OF THE INVENTION

Figure 1:
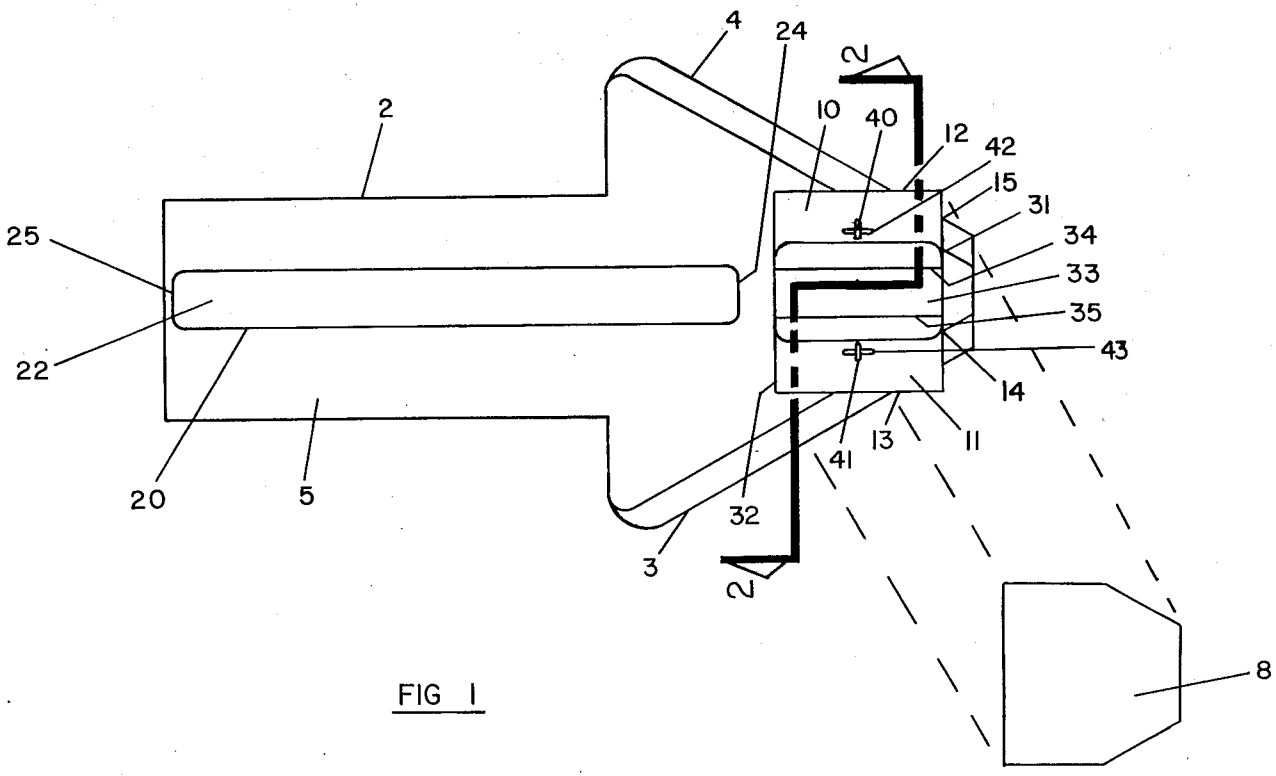
FIG. 1 is a top view of the wallpaper trimmer.
Figure 2:
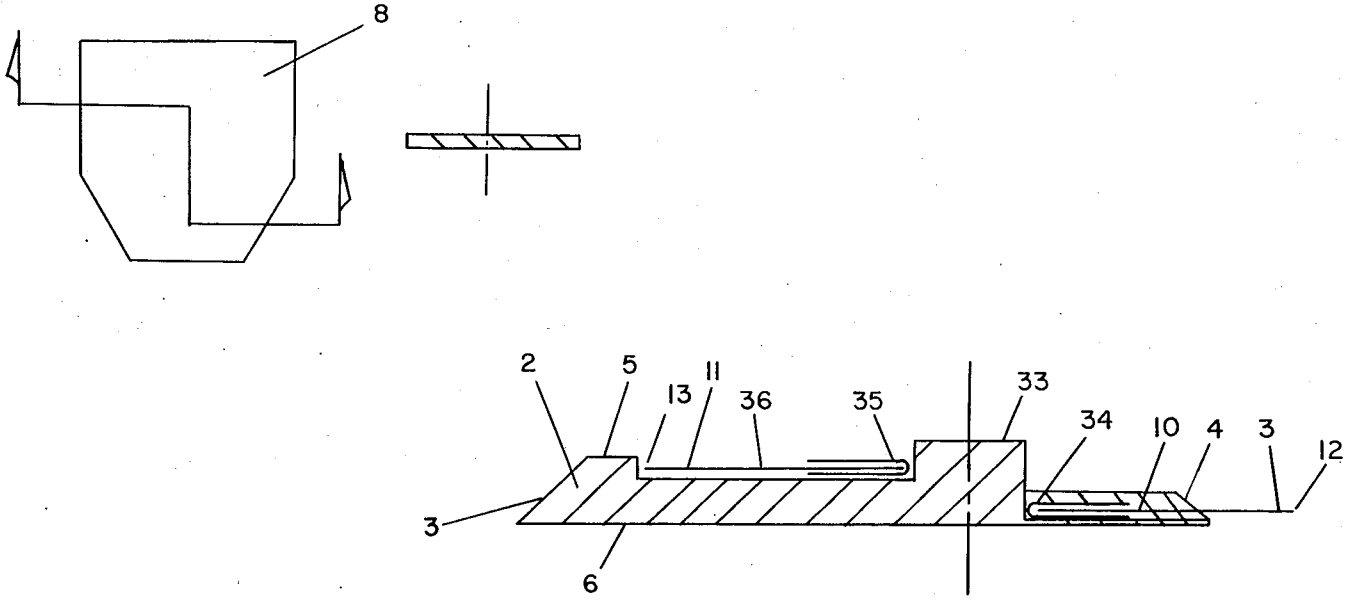
FIG. 2 is a cross sectional front end view of the wallpaper trimmer shown in FIG. 1, taken along the line 2—2 therein.
Figure 2A:
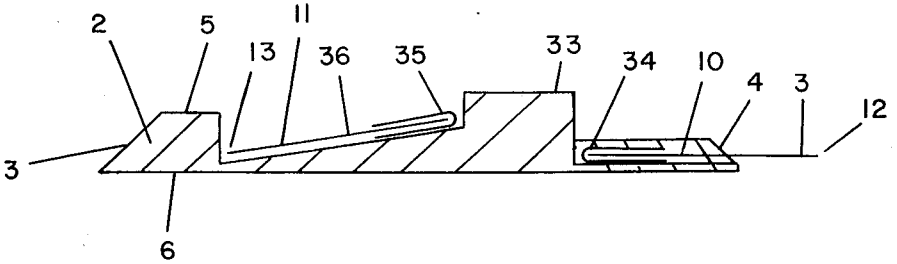
FIG. 2A is a cross sectional front view of a second embodyment.
Figure 3:
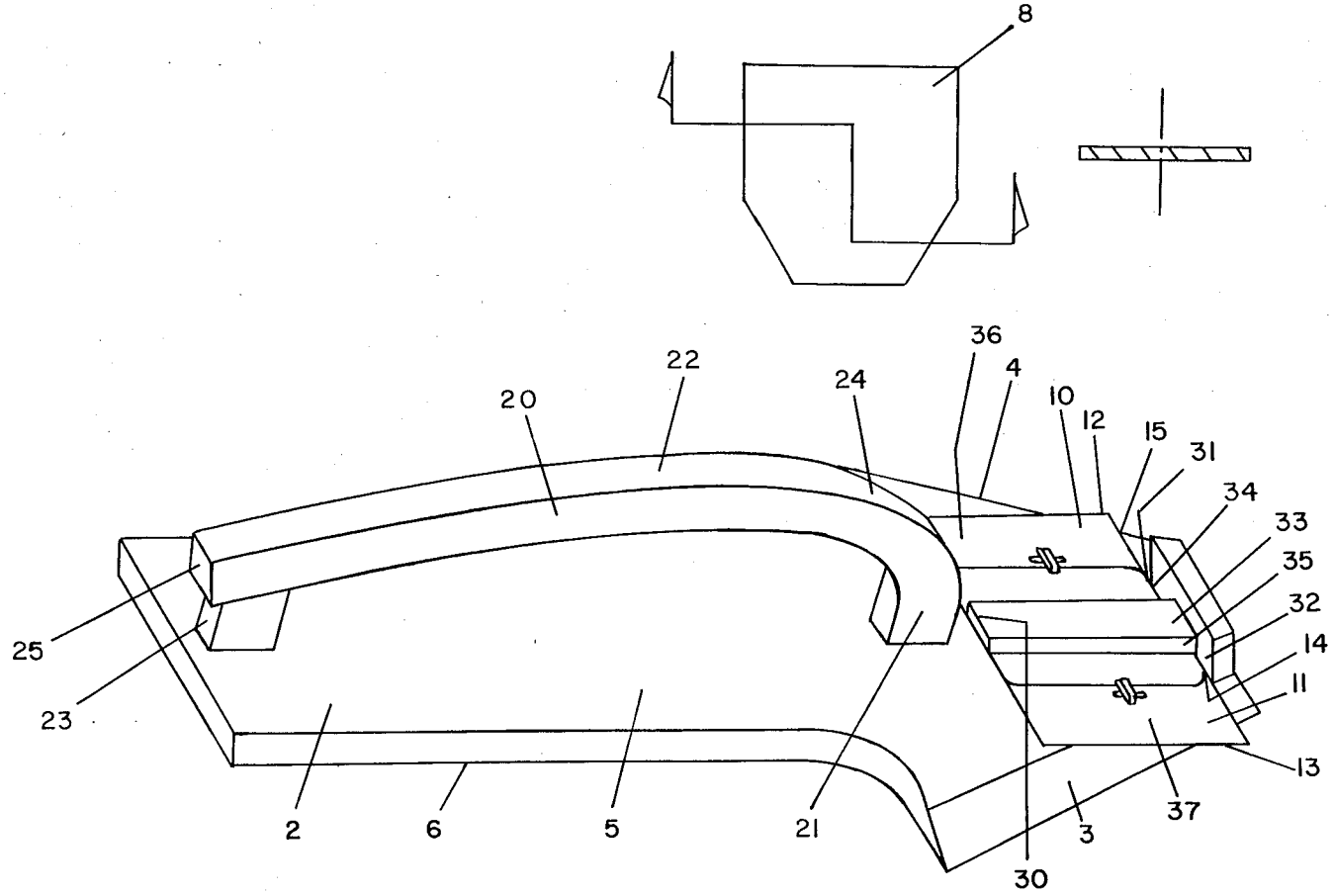
FIG. 3 is a perspective view of the wallpaper trimmer.

Referring to FIGS. 1, 2 and 3, one preferred embodiment of the invention there shown includes a flat horizontal base plate 2 shaped substantially in the form of an arrow head with the acute point removed. The opposite sides of the beveled base plate 3 and 4 converge toward the front of the tool at an acute angle, but do not terminate in a point. The base plate 2 is adapted to abutt slidingly the sheet material which the cutting tool is intended to cut. The acute forward edges of the base plate 3 and 4 are beveled from the upper side 5 of the base plate to the underside 6 of the base plate. The beveled corner edge 3 and 4 of the base plate features an angled edge typically substantially 45° to the principal plane—the base plate 2. Fixedly secured to the upper side 5 of the base plate 2 is a handle 20 adapted to be grasped by a user's hand in a partically closed position when grasping the handle so that the tool may be pulled towards the user during the cutting action. The handle 20 includes a generally forward post 21 and a substantial horizontal portion 22 for grasping attached at its forward end 24 to said forward post 21. Optionally the horizontal portion 22 is attached by a rigid support 23 between the back end 25 of the horizontal portion 22 and the base plate 2. All of this convenient for grasping and firmly guiding the cutting tool when in use during the cutting action.

Fixedly secured to the base plate 2 by a resiliently deformable removable closure plate 8 and extending outwardly from under the closure plate 8 and the base plate 2 through slots 14 and 15 in the upper side 5 of the base plate is a left cutting blade 10 and a right cutting blade 11, respectively, each having a sharpened cutting edge 12 and 13, respectively. Each cutting edge 12 and 13 extends from a point spaced outwardly from the base plate guides 3 and 4 inwardly and backwardly through the slots 14 and 15 towards a back stop 30 within the base plate 2. During cutting the outer cutting edge 12 or 13 of the blades 10 or 11 respectively is forced into the material to be cut and the tool is pulled through the material to provide a amooth cut, while at the same time the base plate 2 maintains secure pressure against the material to be cut and creases the material at the cutting point with the corresponding beveled guide edge 3 or 4 at the meeting line of the surfaces to be covered.

In order to permit the blades 10 and 11 to pass through the beveled guiding edges 3 and 4 of the base plate 2, the slots 14 and 15 extend horizontally through the guide edge 3 and 4 and each is positioned along the upper surface 5 of the base plate positioned forward of the forward handle post 21. To support each blade 10 and 11 a pair of substantially parallel rectangular cross-section recesses 31 and 32 are provided in the upper surface 5 of the base plate. The channels or recesses 31 and 32 include there between a flat slightly raised horizontal longitudinally extending rear surface block 33 and abutting the rear back stop strip of the blades 34 and 35. The block 33 is raised a maximum height of which is equal to the thickness of the back stop of the cutting blades 34 and 35. The block strip 33 extends forward and horizontally from the forward handle post 21 towards the front of the base plate.

Cooperating with said block 33 are a pair of depressions, channels or recesses 31 and 32 to accept the blades 10 and 11. When the blades are placed in the recesses 31 and 32 a small triangular cutting portion extends beyond the edge of the beveled base plate guides 3 and 4 to produce a horizontal cutting edge 12 and 13 and the back edge 34 and 35 of each blade rests securely against the block 33 one on each side. When in the recesses or channels the blades 10 and 11 are substantially aligned in a direction parallel to handle 20 and such that the upper side of the base plate 5 and the adjacent upper side surfaces 36 and 37 of the blades are recessed and swapped therefrom. Alternatively, the recesses 31 and 32 may be parallel or acutely disposed to the center of the base plate.

In order to hold the blade 10 and 11 more securely within the recesses 31 and 32 provision is made for raised posts or pin 40 and 41 provided in the recesses 31 and 32. Therefore, when the blades 10 and 11 are placed in the recesses 31 and 32 each blade lying in the respective recess engages the posts or pins 40 and 41 in the openings in the blades 42 and 43. Alternatively, ordinary single-edge razor blades have a pair of aligned notches one on each of its end, and at a midpoint along its length there is an aperture or slot corresponding to openings 42 and 43 spaced back from the cutting edge of the blade and elongated transversely of the blade and terminating at the inner end of said aperture close to the backing strip 34 or 35 of the blade. As a further alternative the back edge 34 or 35 of the blades may contain a notch which will coincide with a corresponding protrusion in the recesses 31 or 32 or on the block 33.

The cover plate 8 is removably secured to cover the razor blades 10 and 11 by means for retaining said blades within the channels or recesses therefor, while allowing easy removal of the cover plate and blades. Such means for retaining said blades, include for example, deformable cover plate 8 to fit firmly and securely by friction over the recessed blades; alternatively a thumb screw arrangement can be used to securely retain the cover over the blades. A resiliently deformed cover plate results in a constant compressive force exerted by the plate against the blade.

To aid in securely mounting and retaining blades 10 and 11 posts or pins 40 and 41 protrude through and engage the aperture in the blade, the location of which aperture is as indicated at 42 and 43 in the Figures. The blades thus positioned become immovably locked in place in the handtool with the blade's cutting edge projected as shown in FIGS. 1, 2 and 3.

Preferably the recesses for the blades 31 and 32 are ramplike sloped forward and down such that the projected edge of the blade is relatively obliquely disposed to terminate in the same plane as the underside of the base plate 32. In such a relative position the blade will cut at the crease of the sheet material. The crease is formed by the beveled base plate guides 3 or 4 as the tool is pulled across the sheet material to cut at an edge of the object to which the sheet material is applied to produce a cut edge in the close proximity to the edge of the wall or object to which the sheet material is applied.

The method of mounting the blade is also sufficiently firm to prevent lateral torsional deflection of the blade. Such deflection might otherwise be initiated, for example, by offset embossed portion of the material to be cut. If the blade should become blunt or broken, it may be easily replaced by simply removing the coverplate 8 and removing the unwanted blade from the pins or posts 40 and 41.

Alternatively as a safety measure the method of mounting of the blades is in recesses longer than the length of the blades with threaded connectors cooperating with an elongated slot 43 in the blade and threadedly engaged with tapped sockets provided in recesses 31 and 32. When not in use the blades can be retracted into the longer recesses by unthreading the connectors, sliding the blades back and securing the blades therein.

The handtool of the present invention may be used to cut flat surfaces. In cutting a straight line across sheet material a metal straight edge may be laid on the material and used as a guide for the cutting tool which is positioned with one base plate guide as an edge slideably abutting and guided by the straight edge engaging the cutting edge 12 or 13 with the sheet material. The instant tool finds special utility in cutting a straight line at the edge of the meeting line of two surfaces, such as, two walls, a wall and a ceiling or a wall and a floor. The surfaces are usually at a 90° angle each side with respect to the other.

Also as a safety measure this invention includes a removable cover for the blade-containing forward acute angularly shaped portion of the handtool. Thereby covering and protecting the user from injury from the protruding sharpened cutting edges 12 and 13 which extends outwardly from the base plate guides 3 and 4. An envelope shaped to conform to the acute angular shaped forward portion of the handtool is exemplary.

In constructing a hand cutting tool according to the present invention, certain significant advantages are provided.

In particular, the hand cutting tool is arranged and operated to be pulled toward the user (as contrasted to one operated by pushing), permits a steadier smoother cut to be achieved thereby providing for a better fit and closure between subsequent mated edges at the meeting line of two surfaces or two pieces of material.

Also, the provision of the the base plate 2 and edges 3 and 4 stabilizes the cutter against motion out of the straight line at the meeting line of two surfaces.

Although the invention has been described with reference to a preferred embodiment, it will be apparent to those skilled in the art that additions, deletions, modifications, substitutions and other equivalent changes not specifically illustrated and described in the description of the preferred embodiment may be made which will fall within the purview of the appended claims.

What is claimed is:

1. A handtool for close edge cutting and trimming of sheet material, the tool being of the pull-type intended for manual use and pulled toward the user in a forward direction during the cutting and trimming action, said tool comprising:

a base plate having an upper side and a flat underside for slidably engaging the sheet material and maintaining secure pressure against the material;

the base plate having a triangular shape and being beveled along at least one side to provide a guide edge for creasing the material into a corner;

an upwardly projecting handle fixedly secured to the upper side of the base plate;

a pair of horizontally extending recesses formed in the upper side of the base plate each for receiving a cutting blade separated by a dividing strip that locates the blades;

a cutting blade removably mounted in each of said recesses and having a cutting edge extending outwardly beyond said guide edge to cut the material while it is being engaged by said flat underside and creased by said guide edge; and means for securedly removably holding the cutting blade within said recess.

2. The handtool of claim 1 wherein the cutting edge of said blade terminates in approximately the same plane as the underside of said base plate.

3. The handtool of claim 1 wherein said recess is sloped so that the cutting edge of said blade terminates in approximately the same plane as the underside of said base plate.

4. A handtool as defined in claim 1 wherein the parallel recesses are enlarged for mounting the cutting blades which allows adjustment of the exposed cutting edge outward and forward from the beveled angular guide edges.

5. A handtool as defined in claim 1 further characterized by each of said blades projecting from said base plate at an acute angle with the angular guiding edges extending outwardly therefrom and in close proximity thereto.

6. A handtool as defined in claim 1 wherein said closure plate is provided with means for removably securely fastening the closure plate over the blades in the recesses therefor.

7. The handtool as defined in claim 1 including a resiliently deformable removable cover plate for covering and retaining the blades in cutting position in the base plate.

8. A handtool for close edge cutting and trimming of sheet material, the tool being of the pull-type intended for manual use and pulled toward the user in a forward direction during the cutting and trimming action, said tool comprising:

a base plate having an upper side and a flat underside for slidably engaging the sheet material and maintaining secure pressure against the material;

the base plate having a triangular shape and being beveled along at least one side to provide a guide edge for creasing the material into a corner;

an upwardly projecting handle fixedly secured to the upper side of the base plate;

a pair of horizontally extending recesses formed in the upper side of the base plate each for receiving a cutting blade separated by a dividing strip that locates the blades, said recesses for the cutting blades are sloped forward and downwardly in order to project the exposed corner edge of the blade obliquely to terminate in the same plane as the underside of the base plate;

a cutting blade removably mounted in each of said recesses and having a cutting edge extending outwardly beyond said guide edge to cut the material while it is being engaged by said flat underside and creased by said guide edge; and means for securedly removably holding the cutting blade within said recess.

* * * * *